United States Patent [19]

Ilon

[11] Patent Number: 4,727,662

[45] Date of Patent: Mar. 1, 1988

[54] WALKING FACILITY OR ANTI-SKID MEANS FOR FOOTGEAR

[76] Inventor: Bengt E. Ilon, Schädrütihalde 4, CH-6006 Luzern, Switzerland

[21] Appl. No.: 5,027

[22] PCT Filed: Mar. 12, 1986

[86] PCT No.: PCT/SE86/00106

§ 371 Date: Nov. 14, 1986

§ 102(e) Date: Nov. 14, 1986

[87] PCT Pub. No.: WO86/05370

PCT Pub. Date: Sep. 25, 1986

[30] Foreign Application Priority Data

Mar. 14, 1985 [SE] Sweden ..... 8501267

[51] Int. Cl.[4] ..... A43C 15/00; A43C 15/02; A43B 5/00

[52] U.S. Cl. ..... 36/132; 36/7.6; 36/62; 36/117

[58] Field of Search ..... 36/7.5, 7.6, 59 R, 59 C, 36/59 D, 61, 62, 64, 65, 117, 132

[56] References Cited

U.S. PATENT DOCUMENTS 4,160,301 7/1979 Woolley ..... 36/132 X
4,228,602 10/1980 Groves ..... 36/132
4,286,397 9/1981 Booty ..... 36/132
4,294,025 10/1981 Keller ..... 36/132

FOREIGN PATENT DOCUMENTS 2314847 10/1974 Fed. Rep. of Germany ..... 36/132
2506751 8/1976 Fed. Rep. of Germany ..... 36/132
595791 9/1975 Switzerland ..... 36/132

*Primary Examiner*—Donald Watkins
*Attorney, Agent, or Firm*—Bacon & Thomas

[57] ABSTRACT

The present invention relates to a device intended to be positioned under footgear as a walking facility and/or anti-skid means, whereby the device comprises a tread means (3) which is fastenable at the front and at the back of the footgear (2) through fore and rear anchoring members (4 and 5 respectively). In order to be adapted to shoes of various size, be firmly fastened and quickly removed in a simple manner and, after use, assume such a shape that it may be put away in any small space, e.g. a trousers-pocket, the tread means (3) is zigzag-shaped, in its normal shape substantially shorter than the footgear (2) and straightenable through elongation with regard to its zigzag-shape for increasing the length thereof, whereby said tread means is fastenable to the footgear.

14 Claims, 8 Drawing Figures

FIG. 1
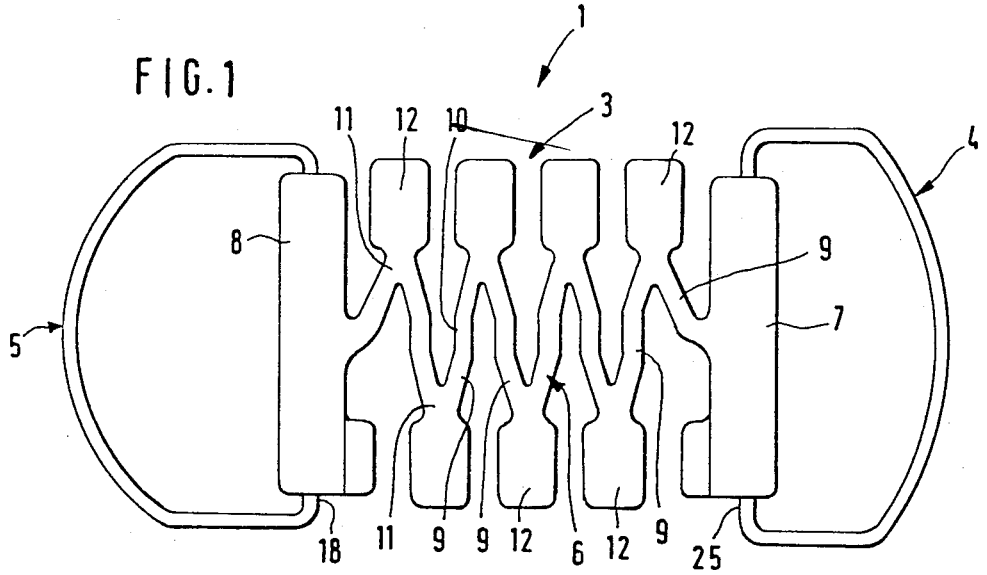
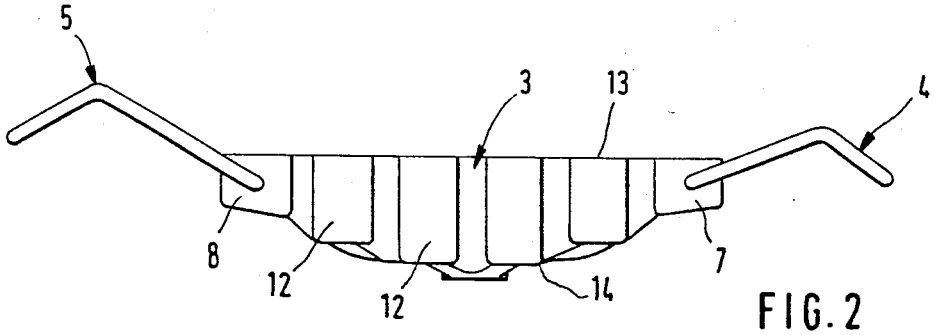
FIG. 2
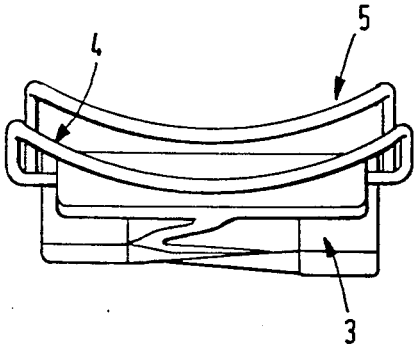
FIG. 3

WALKING FACILITY OR ANTI-SKID MEANS FOR FOOTGEAR

The present invention relates to a device intended to be positioned under footgear as a walking facility and/or anti-skid means, whereby the device comprises a tread means which is fastenable at the front and at the back of the footgear through fore and rear anchoring members.

Numerous devices have been made in order to facilitate walking and/or reduce the risk for slipping with footgear, especially ski boots with rigid leg portions. Examples of such devices are described in U.S. Pat. Nos. 3,965,586 and 4,156,316, DE-OS Nos. 22 23 480, 24 24 875 and 26 52 654 and NO-PS No. 139 073. The problem with this prior art device has been that they can not be adapted to shoes of different size, they can not be rigidly fastened or quickly removed therefrom in a simple manner and they can not, after use, assume such a shape that they can be put away in some small space, e.g. a trousers-pocket.

Therefore, the object of the present invention is to, at first hand, provide a walking facility and/or anti-skid means which may be adapted to shoes of various size, may be fastened and quickly removed in a simple manner and, after use, may assume such a small shape that it may be put away in small spaces, e.g. a trousers-pocket. This is arrived at according to the invention substantially while the walking facility and/or anti-skid means has obtained the characterizing features of claim 1.

While the tread means of the invention has a zigzag shape and normally is substantially shorter than the footgear, it is easy to put away in small spaces, and the zigzag shape permits an increase of the length of the tread means by elongation thereof and thus, straightening from a contracted to a more elongated zigzag-shape. The zigzag-shape also permits elongation of the tread means to various extents for adapting the length thereof to footgear of various size and it makes it easy to fasten the tread means and keep it in a firm grip on the footgear because of the condition thereof.

The invention will be further described below with reference to the accompanying drawings, wherein FIG. 1 is a top plan view of the device according to the invention in its normal shape;

FIG. 2 is a side view of the device;

FIG. 3 is a front view of the device;

Figure 4:
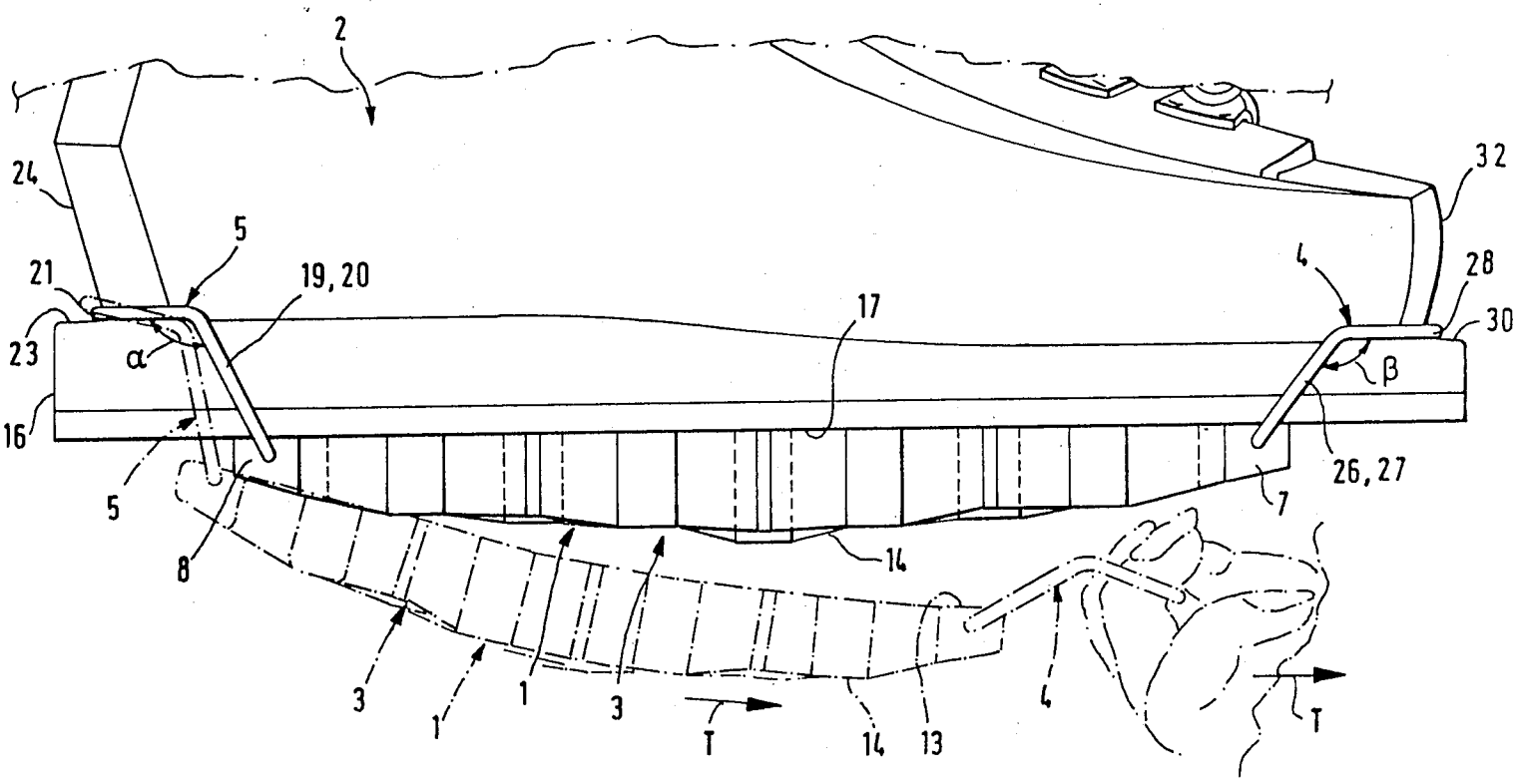
FIG. 4 is a side view of the device during extension thereof for application on a shoe or boot and in extended or elongated condition after application on the shape or boot.

The device 1 illustrated in the drawings is intended to be positioned under footgear, i.e. a shoe or boot 2, preferably ski-boots with rigid leg portions, as a walking facility and/or anti-skid means. The device 1 comprises a tread means 3 which is fastenable at the front and back of the footgear 2 by means of fore and rear anchoring members 4 and 5 respectively. The illustrated tread means 3 is made of rubber material or any corresponding elastic polymer and it consists of a zigzag-shaped band 6 extending standing between forward and rearward end portions 7 and 8 respectively. In retracted normal shape (see FIG. 1), reciprocating portions 9 of the zigzag-shaped band 6 extend in a direction substantially transverse to that direction T wherein the tread means 3 is intended to be elongated or extended. Furthermore, central parts 10 of the reciprocating portions 9 extend at a distance from each other only somewhat exceeding the thickness of said reciprocating portions 9 (the distance between the central parts 10 is in the embodiment shown 5 mm, while the thickness of the portions 9 is 4 mm). The reciprocating portions 9 transcend into each other via transition portions 11 which on the inner side are preferably rounded and on the outer side transformed into outer tread portions 12 that are somewhat thicker than two reciprocating portions 9 connected thereto (the outer tread portions are in the embodiment shown 12 mm, while the total thickness of two reciprocating portions is 8 mm).

The zigzag-shaped band 6 is connected to central portions of the forward and rearward end portions 7, 8, whereby it is ensured that the zigzag-shaped band 6 does not unevenly load said end portions 7, 8 when the tread means 3 is elongated. The end portions 7, 8 are substantially thicker than the zigzag-shaped band 6 and have substantially the same thickness as height. The length of the end portions 7, 8 correspond substantially with the width of the underside 17 of the shoe and the length of the portions of the tread means 3 lying therebetween when said tread means has its normal shape, or is the length of said end portions 7, 8 somewhat less than said intermediate portions when the tread means 3 has its normal shape. By making the end portions 7, 8 relatively strong, they can better resist the loads generated during walking when they hit the ground. Since the end portions 7, 8 are relatively strong, they also provide stable attachments for the anchoring members 4, 5.

One side 13 of the tread means 3, namely the side intended to engage the footgear 2, is planar, while the opposite side 14 of the tread means 3 is designed such that the central parts of the tread means 3 have the greatest height and that the height is successively reduced towards the end portions 7, 8. Thereby,the reciprocating portions 9 of the zigzag-shaped band 6 transcend into each other such that, when more or less straightened after elongation of the tread means 3, they together make the side 14 arcuate. Hereby, the zigzag-shaped band 6, when the tread means 3 in elongated condition is fastened under the footgear 2, provides an arcuate side 14 extending along the underside of the footgear and intended to end somewhat within the tip of the toe 15 and the rear edge of the heel 16 of said footgear, whereby an extension of the arcuate side 14 in the forward direction meets substantially the edge point of the footgear between the tip of the toe 15 and the underside 17 of the footgear and an extension of the arcuate side in the rearward direction meets substantially en edge point between the footgear underside 17 and the rear edge of the heel 16. The arcuate shape may coincide or substantially concide with a portion of a circular arc. Hereby, the tread means 3 provides a suitably bevelled underside 14, on which each step may "roll off" in a comfortable manner, such that the walking comfort is substantially increased, especially when the tread means 3 is used on ski-boots with rigid leg portions counteracting the walking movement of the foot.

Elongation or extension of the tread means 3 from contracted normal shape is permitted while the reciprocating portions 9 of the zigzag-shaped band 6 may be more or less straightened relative to each other depending on the elongation stresses applied onto the tread means. The tread means 3 may be fastened to footgear 2 of the illustrated length, whereby the zigzag-shaped band 6 has en elongated zigzag-shape (FIG. 5), but it may e.g. be further extended for fastening to longer footgear 2, whereby the zigzag-shape of said band 6 is further elongated. The zigzag-shaped band 6 has reached its maximum length when it is substantially straightened, but further extension is possible while the tread means 3 is made of elastic material.

The more the zigzag-shaped band 6 is extended, the thinner it becomes. While the outer tread portions 12 has a lenght corresponding to about 25% or more of the width of the footgear 2, the thinnest part of the band 6 will be not less than 50% of the width of the footgear even if the band is almost completely straightened. Such a minimum width of the band 6 is fully sufficient to guarantee side stability while walking, especially since the end portions 7, 8 are preferably designed almost as wide as the footgear. At a suitable ratio between the width of the footgear and the dimensions of the tread means 3, the width of the band 6 in elongated condition after fastening the tread means 3 to the footgear 2, including its outer tread portions 12, is only somewhat less than the width of the footgear, and the outer tread portions 12 will be directed transversely to the direction of elongation T (and thus, the walking direction) independent of how much the band 6 is extended (see FIG. 5).

The rear anchoring member 5 comprises a rigid metal yoke, which through an unbroken bearing member 18 is pivotally journalled in the rearward end portion 8. The yoke has two shanks 19 and 20 projecting angularly from the unbroken bearing member 18 and connected to each other through a bevelled connecting portion 21. The shanks 19, 20 are disposed at a distance from each other corresponding to or only somewhat exceeding the width of the heel 22 of the footgear 2. The size of the bevelled connecting portion 21 is adapted such that said portion may be positioned on the upper edge 23 of a rearwardly protruding part of the heel 22 and the connecting portion is designed to engage a part 24 of the footgear 2 extending upwardly from the heel 22. As seen from the side, the shanks 19, 20 and the connecting portion 21 make an angle $\alpha$ with each other and this angle $\alpha$ is larger than 90°, e.g. about 120°. Due to this design of the yoke, the tread means 3 will press down the connecting portion 21 against the upper edge 23 and maintain said portion 21 against said upper edge 23 through the force striving to contact the tread means 3 to its normal shape when elongated.

The fore anchoring member 4 comprises a rigid metal yoke, which through an unbroken bearing member 25 is pivotally journalled in the forward end portion 7. The yoke has two shanks 26 and 27 projecting angularly from the unbroken bearing member and connected to each other through a bevelled connecting portion 28. The shanks 26, 27 are disposed at a distance from each other exceeding the width of the toe portion 29 of the footgear 2. The size of the bevelled connecting portion 28 is adapted such that the connecting portion 28 may be positioned on the upper edge 30 of a forwardly protruding part 31 of the toe portion 29 and said connecting portion 28 is designed to engage a shoe member 32 extending upwardly from said protruding part 31. As seen from the side, the shanks 26, 27 and the connecting portion 28 make an angle $\beta$ with each other and this angle $\beta$ is larger than 90° and preferably about 120°: Through this design of the yoke the tread means 3 will press down the connecting portion 28 against the upper edge 30 and maintain it thereagainst through the force striving to contract the tread means 3 to its normal shape when said means is elongated.

The fore anchoring member 4 may be somewhat wider than the rear anchoring member 5, among other things in order to facilitate insertion of the anchoring members 4, 5 into each other when the device 1 is compressed to its compressed shape, in which the device is easy to put away in small spaces.

The device 1 is fastened to the footgear 2 in a simple manner. Thus, you grip e.g. the fore anchoring member 4, dispose the device 1 under the footgear 2 and place the connecting portion 21 of the rear anchoring member 5 on the upper edge 23 of the heel 22. Now, the device 1 is in the position illustrated with dashed and dotted lines in FIG. 4 with the tread means 3 in its normal shape. Thereafter, you pull the fore anchoring member 4 in a forward direction (arrow T in FIG. 4), whereby the zigzag-shaped band 6 of the tread means 3 is elongated. The fore anchoring member 4 is pulled forwards so far that it may be swung up over the tip of the toe 15. When the fore anchoring member 4 has been swung upwards so far that the connecting portion 28 thereof is positioned above the forwardly protruding part 31, said anchoring member 4 may be released, which means that the elongated tread means 3, due to its inherent contracting force, snaps the anchoring member downwards/backwards until the anchoring portion 28 thereof engages the upper edge 30 and the upwardly extending member 32 of the footgear 2. Thereby, the device 1 will assume the position illustrated in FIGS. 4 and 5 under the footgear with its highest portion about half the way between the heel and the toe, whereby especially the rear anchoring member 5 assists in maintaining the device 1 in position when subjected to side loads while walking, but also all parts of the tread means 3 engaging the underside 17 of the shoe or footgear assist in keeping the device 1 in position when it is subjected to side loads.

Besides the tread means 3 thereby providing a favourable rounded or bevelled, arcuate side 14 which substantially increases the walking comfort, the zigzag-shaped band 6, the outer tread portions 12 sitting thereon and the forward and rearward end portions 7, 8 provide members preventing slipping under the footgear, which is facilitated by the fact that most of these members extend transverse to the walking direction.

Instead of first fastening the rear anchoring member 5 to the footgear 2, the fore anchoring member 4 may be fastened first and the device may be removed simply by extending it somewhat and bring one of the anchoring members 4 or 5 down and over the heel or toe of the footgear 2. The other anchoring member is thereby released and the tread means 3 will contract to its normal shape.

Figure 6:
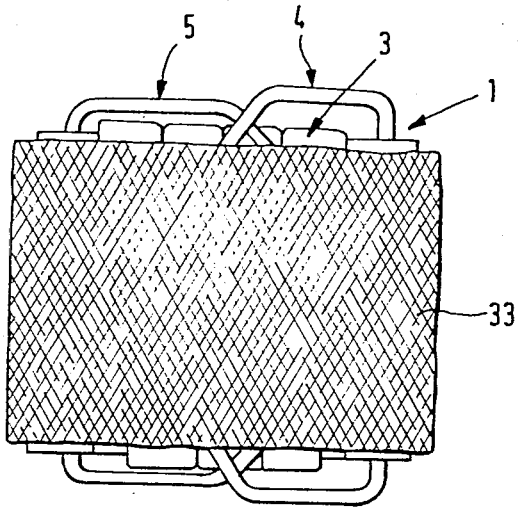
FIG. 6 is a top plan view of the device in compressed condition with a ring drawn thereonto.
Figure 8:
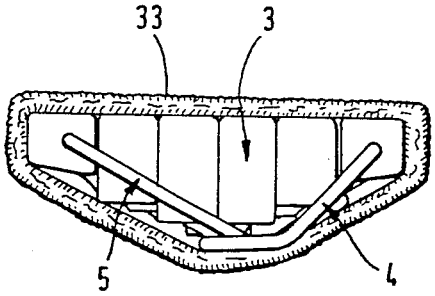
FIG. 8 is a side view of the device in compressed condition.

In order to remove snow and dirt before putting the device 1 away, it may be completely celansed simply by holding it in one of the anchoring members 4, 5 and tap it against the leg or any object. The size of the device 1 is such in its normal shape that it is easily put away whereever convenient, e.g. in a bag, for reuse at a later occasion, e.g. after skiing on the way from the skiingslide to the car. However, the size of the device 1 may be reduced by compressing it from its normal shape to a compressed shape, at which the length thereof corresponds with the total thickness of the end portions 7, 8 and all outer tread portions 12 (see figure 6). After compression of the tread means 3, the anchoring members 4, 5 may be swung in and over the side 14 of the tread means 3 until they extend into each other (see FIG. 8). Thereafter, the total length and height of the device is almost equal to the total length and height of the tread means 3 when compressed.

Figure 7:
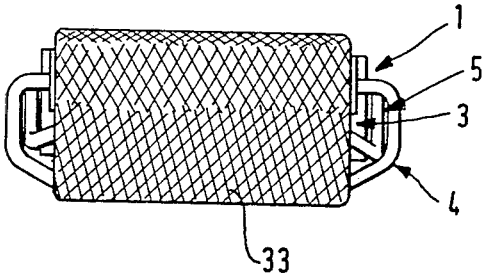
FIG. 7 is a front view of the device in compressed condition.

The tread means 3 may be kept in compressed shape while the anchoring members 4, 5 are so designed that they may be hooked onto each other by pressing them into each other. In combination herewith or as an alternative hereto, you may use a retaining ring 33 which is drawn over the tread means 3 when compressed in order to maintain said means in its compressed shape (see FIG. 8). The retaining ring 33 is suitably almost as wide as the tread means 3 (see FIGS. 6 and 7) and it may consist of or have on its surface a moisture-absorbent material for absorbing moisture such that the clothes are not getting wet when putting the device 1 in e.g. the pocket in a wet or damp condition.

While the tread means 3 has not a completely contracted normal shape, several advantages are obtained during manufacture and with regard to the shape during elongation and the tread means 3 is easier to cleanse than if it is completely contracted after use.

Figure 5:
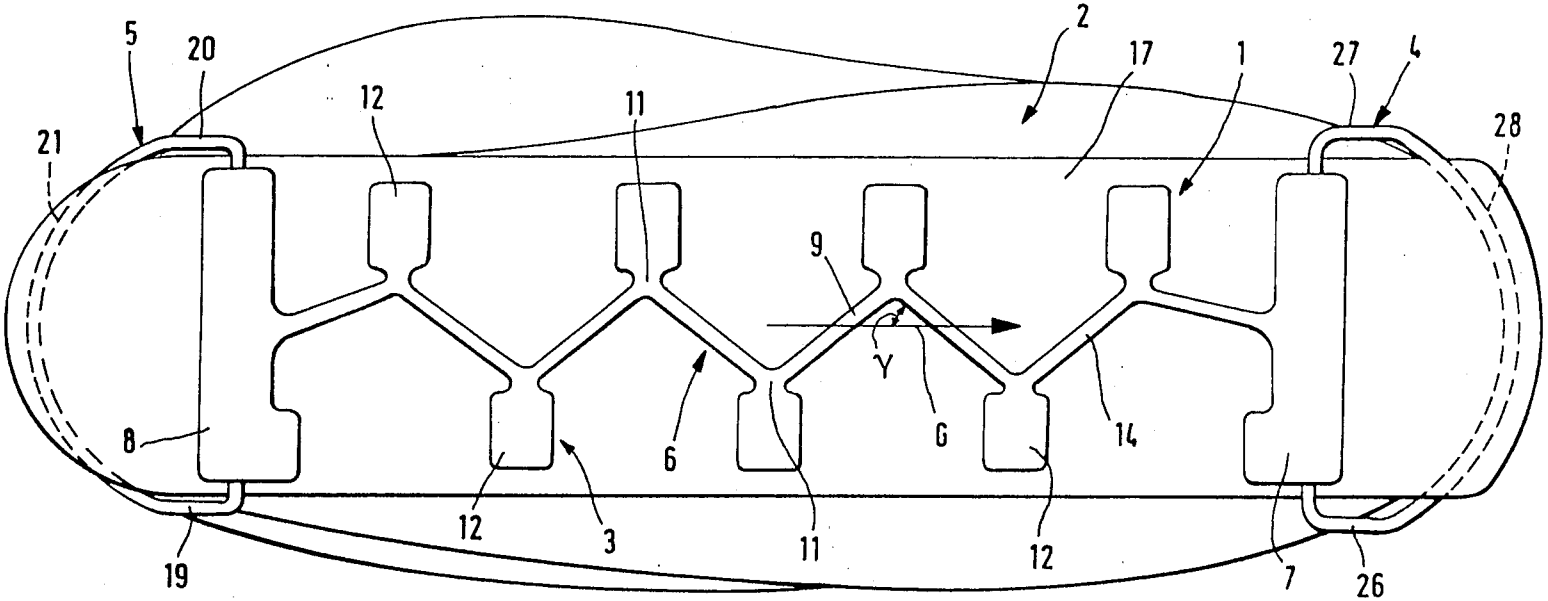
FIG. 5 is a top plan view of the device in extended condition after application thereof on the shoe or boot.

The size of the illustrated device 1 is well adapted to the size of the footgear shown in FIGS. 4 and 5. When the device 1 is fastened to the footgear 2, the zigzag-shaped band 6 is stretched not more than an angle $\gamma$ between the reciprocating portions 9 and the walking direction G is about 30°. With this shape, the reciprocating portions 9 provide a good anti-skid effect and the outer tread portions 12 will extend almost to the longitudinal sides of the sole of the footgear. However, the device 1 may be adapted to shorter or longer footgear. If the footgear is shorter the angle $\gamma$ will be larger and the outer tread portions 12 will lie even closer to the longitudinal sides of the sole. If the footgear is longer, the angle $\gamma$ will be less and the outer tread portions 12 will lie farther in. However, the outer tread portions 12 have such a length that the required side stability is obtained during walking even if the device 1 is fastened to so long footgear that the zigzag-shaped band 6 is completely or almost completely stretched, i.e. the angle $\gamma$ is almost 0°.

The essential properities of the device 1 according to the invention, namely that it may be adapted to footgear of various lengths while maintaining the required walking comfort and/or anti-skid means, that it may be fastened and removed in a simple manner on shoes of various lengths and that it is easy to put away after use, are arrived at at first hand through the features defined in claim 1. The device described and shown in the drawings is an especially advantageous embodiment of the invention, but it may vary in shape without loosing its essential properities. Thus, the tread means 3 may comprise one unit which in all parts is elastic and consists of unarmoured or armoured rubber or similar elastic polymer material. Alternatively, the tread means 3 may consist of a totally different material than rubber or partially of rubber or a similar elastic polymer and partially of another material. The tread means 3 may eventually be only partly elastic, i.e. certain parts thereof may eventually be inelastic. Eventually, the zigzag-shaped band 6 of the tread means 3 may comprise reciprocating portions which are pivotally connected to each other and affected by spring means for contracting the band. At the illustrated tread means 3, the zigzag-shaped band 6 is intended to stand upright under the footgear and this position is maintained irrespective of how much it is elongated. However, it is possible to design the tread means 3 to provide transverse ridges under the footgear, but hereby the ridges loose height the more the tread means 3 is extended.

Thus, many alternative embodiments of the tread means are possible within the scope of the invention and in order to improve the grip of the tread means 3 onto the ground, said means may comprise depending dowels, spikes or similar preferably of harder material than the tread means 3.

The shape of the anchoring members 4, 5 may also vary, they may e.g. have the same width and be made of elastic or another material. Eventually, it is in certain cases advantageous to tie the fore and rear anchoring members 4, 5 to each other. This may be done by means of two laces or similar of which one extends along the inner side of the footgear and the other along the outer side thereof. These laces are connected to each other through a connecting lace extending above the footgear. This construction sees to that the device 1 is very rigidly fastened to the footgear 2.

The device 1 of the invention is intended to be used especially at ski-boots, but may or course also be used at other types of footgear with the same excellent properities.

I claim:

1. Device intended to be positioned under footgear as a walking facility and/or anti-skid means, whereby the device comprises a tread means (3) which is fastenable at the front and at the back of the footgear (2) through fore and rear anchoring members (4 and 5 respectively), characterized in that the tread means (3) is zigzag-shaped, in its normal shape substantially shorter than the footgear (2) and straightenable through elongation with regard to its zigzag-shape for increasing the length thereof, whereby said tread means is fastenable to the footgear.

2. Device according to claim 1, characterized in that central parts of the zigzag-shaped tread means (3) have the greatest height and/or hardness, whereby said central parts of the zigzag-shaped tread means are intended to be disposed substantially between the toe and the heel of the footgear (2).

3. Device according to claim 1, characterized in that the zigzag-shaped tread means (3) comprises an extendable member in the form of a zigzag-shaped band (6) which in its normal shape has in zigzag-shape reciprocating portions (9) adapted to together define a continuous, along the footgear (2) extending underside (14) which, seen from the side, is arcuate and which, seen from below, has a more or less elongated zigzag-shape.

4. Device according to claim 3, characterized in that the zigzag-shaped band (6), at transition portions (11) wherein the reciprocating positions (9) transcend into each other, comprises outer tread portions (12) extending transverse to the direction (T) in which said zigzag-shaped band is extendable, whereby the length of said outer tread portions substantially corresponds with or exceeds 25% of the width of the footgear (2) on which the device (1) shall be fastened.

5. Device according to claim 3, characterized in that is has such a length in relation to footgear (2) on which it shall be fastened, that the reciprocating portions (9) of the zigzag-shaped band (6) extend with an angle ($\gamma$) relative to the walking direction (G) when the device (1) is fastened to the footgear, whereby said tread portions (12) extend almost to longitudinal sides of the underside (17) of the footgear.

6. Device according to claim 3, characterized in that the zigzag-shaped band (6) extends between two end portions (7, 8) which are intended to extend transverse to the walking direction (G) of the footgear (2) when the device (1) is fastened to said footgear, whereby said end portions have a length substantially corresponding with the width of the footgear underside (17) and whereby anchoring members (4, 5) are journalled in said end portions for fastening the device (1) at the front and at the back of the footgear.

7. Device according to claim 6, characterized in that the zigzag-shaped band (6) is connected to central parts of the end portions (7, 8).

8. Device according to claim 11, characterized by fore and rear anchoring members (4 and 5 respectively) having shanks (26, 27 and 19, 20 respectively) provided on the tread means (3) and connected to each other through connecting portions (28 and 21 respectively) which are intended to extend around respective fore and rear upwardly extending parts (32 and 34 respectively) of the footgear (2) and engage from above upper edges (30 and 23 respectively) defined by respective forwardly and rearwardly protruding parts of the footgear, whereby the distance between the shanks of at least one of said anchoring members (4 and/or 5) corresponds with or slightly exceeds the width of that part of the footgear on which the anchoring member shall be fastened and whereby said anchoring members (4 and 5) are pivotally connected to the tread means (3) and the shanks (26, 27; 19, 20), as seen from the side, extend with such an angle ($\alpha$) in relation to the respective connecting portion (28; 21) that the connecting portion is pressed down against the respective upper edge (30; 23) of the tread means when the device (1) is fastened to the footgear (2).

9. Device according to claim 3, characterized in that the reciprocating portions (9) of the zigzag-shaped band (6) forming part of the tread means (3), extend at some distance from each other when the tread means is in its normal shape.

10. Device according to claim 9, characterized in that the tread means (3) is compressible from its normal shape to compressed shape and that said tread means is maintained in compressed shape by means of anchoring members (4, 5) provided thereon and/or a retaining ring (33) drawn thereover after insertion of said anchoring members into each other.

11. Device according to claim 10, characterized in that the retaining ring (33) consists of or includes moisture absorbent material.

12. Device according claim 1, characterized in that the tread means (3) consists of a unit of rubber material or a corresponding elastic polymer and that rigid and yoke-like anchoring members of metal are provided on said tread means.

13. Device according to claim 1, characterized in that the tread means has spikes or similar as an anti-skid means.

14. Device according to claim 1, characterized in that fore and rear anchoring members (4, 5) for fastening the tread means (3) to the footgear (2) are lockable to said footgear by means of laces or similar extending thereabove.

* * * * *